US005778626A

United States Patent [19]

Hellsten

[11] Patent Number: 5,778,626

[45] Date of Patent: Jul. 14, 1998

[54] CLOSED BEAM WITH EXPANDED METAL SECTIONS

[76] Inventor: Mikael Hellsten, Lychevägan 3, S-311 92 Falkenberg, Sweden

[21] Appl. No.: 836,178

[22] PCT Filed: Sep. 2, 1996

[86] PCT No.: PCT/SE96/01081

§ 371 Date: Apr. 23, 1997

§ 102(e) Date: Apr. 23, 1997

[87] PCT Pub. No.: WO97/09496

PCT Pub. Date: Mar. 13, 1997

[30] Foreign Application Priority Data

Sep. 7, 1995 [SE] Sweden ..... 9503074

[51] Int. Cl.[6] ..... E04C 3/09

[52] U.S. Cl. ..... 52/731.2; 52/670; 52/731.3; 52/737.6; 29/6.1; 29/897.31; 29/897.35

[58] Field of Search ..... 52/670, 724.3, 52/731.2, 731.3, 737.6; 29/6.1, 897.3, 897.31, 897.35

[56] References Cited

U.S. PATENT DOCUMENTS

| | | | |
|---|---|---|---|
| 1,656,810 | 1/1928 | Arnstein | 52/731.2 X |
| 3,108,406 | 10/1963 | Ellis | 52/670 |
| 3,282,005 | 11/1966 | Birdwell | 52/731.2 X |
| 3,812,558 | 5/1974 | Watanabe | 29/6.1 |
| 4,305,187 | 12/1981 | Iwamura et al. | 29/6.1 X |

*Primary Examiner*—Christopher Kent
*Attorney, Agent, or Firm*—Young & Thompson

[57] ABSTRACT

An elongate beam that is constructed of a sheet metal having expanded metal sections. The beam has a closed profile that has at least two side sections made with the expanded metal. The opposite side edges of the sheet metal are attached to one another so that the sheet metal forms a closed beam structure.

11 Claims, 3 Drawing Sheets

CLOSED BEAM WITH EXPANDED METAL SECTIONS

The present invention relates to a beam with a fully and/or partially closed profile exhibiting at least two sides.

BACKGROUND INFORMATION AND SUMMARY OF THE INVENTION

A considerable need exists in many technical areas for beams of low weight, high strength with regard to both resistance to bending and resistance to compression, and advantageous collapse characteristics. Such beams are desirable in the vehicle industry, the construction industry, the road equipment industry etc., and especially the passenger car industry, since an advantageous weight-to-strength ratio permits lower fuel consumption and advantageous collapse characteristics or a considerable capacity to absorb high energy in the course of deformation to a state in which the beam may be regarded as having collapsed. This latter characteristic is desirable in so-called impact protection zones in passenger cars, buses and lorries or similar vehicles.

The basis of the present invention is the problem of satisfying the aforementioned requirements.

This problem is solved in accordance with the present invention by the beam referred to by way of introduction, in that the beam is profiled from a coiled sheet metal strip which exhibits an elongated section of expanded metal along at least one side of the finished profile, in that the sections of the sheet metal strip connecting the sides are unbroken, and in that both meeting edges of the sheet metal strip are connected or attached to one another to form the closed profile. All the sides exhibit one or more sections of expanded metal. The sections connecting the sides are unbroken. The sides are connected or attached to one another to form the closed profile. Two of the sides are connected to one another by folding the unbroken edge sections. Two of the sides are connected to one another by welding. When the beam has a multi-sided closed profile, it is advantageous for the corner sections to be unbroken and for the fold or connection closing the profile to be situated at one of the corners in the unbroken edge sections. The beam is profiled from a sheet metal strip which exhibits an elongated section of expanded metal on each side of the finished profile and an elongated section of sheet metal strip at each corner.

A beam in accordance with the present invention provides unimagined opportunities within many technical areas, where components can be made appreciably lighter without in any way having to jeopardize the strength of the component in question. Appreciably improved energy-absorbing characteristics are also offered, since appreciably greater energy is consumed or required to bring about the complete collapse of a beam in accordance with the present invention than in the case of conventional beam structures. A beam in accordance with the present invention also permits economies of both space and weight, which in turn lead to appreciably better operating economy. A beam in accordance with the present invention also permits the use of simpler and more efficient installation and assembly methods.

DETAILED DESCRIPTION

Figure 1:
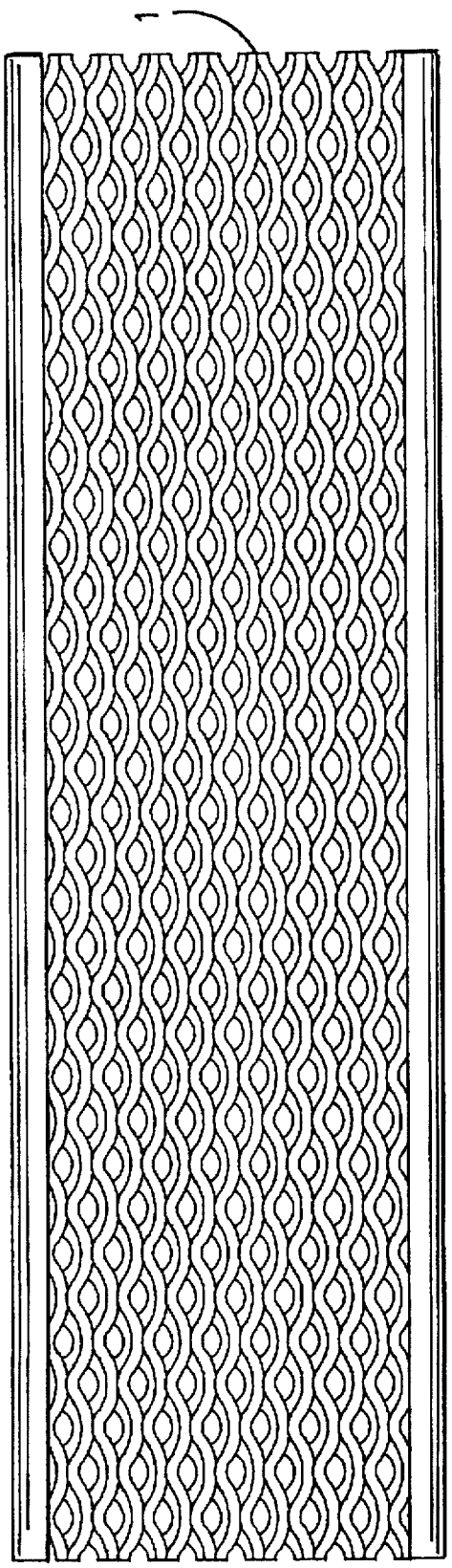
FIG. 1 is an elevational front view of a preferred embodiment of the beam of the present invention.
Figure 2:
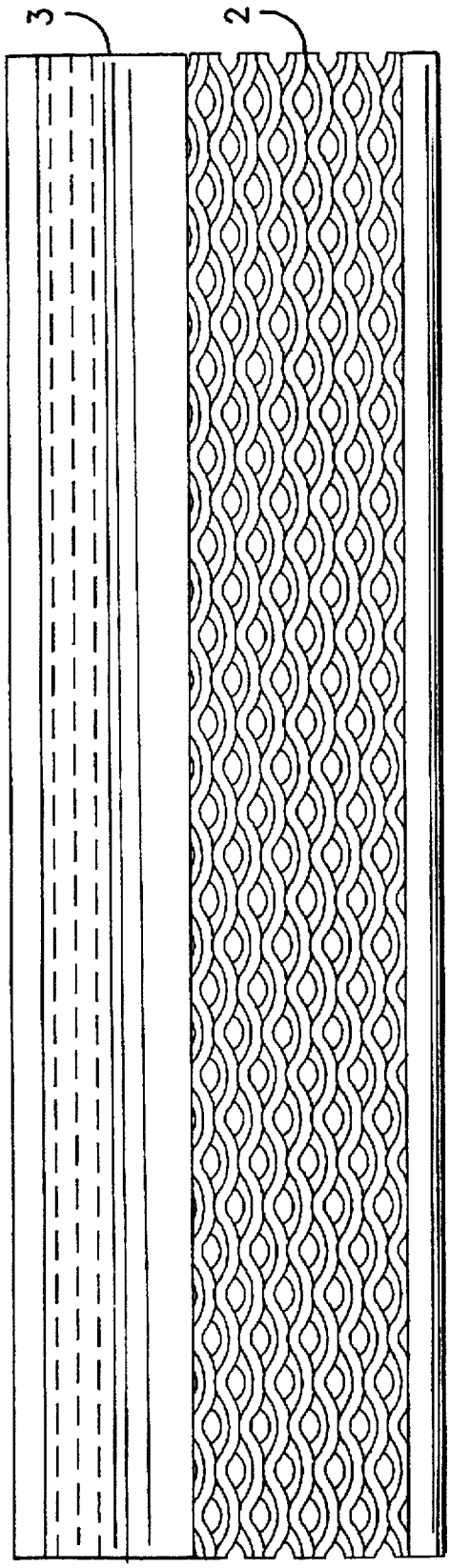
FIG. 2 is an elevational rear view of the embodiment shown in FIG. 1.
Figure 3:
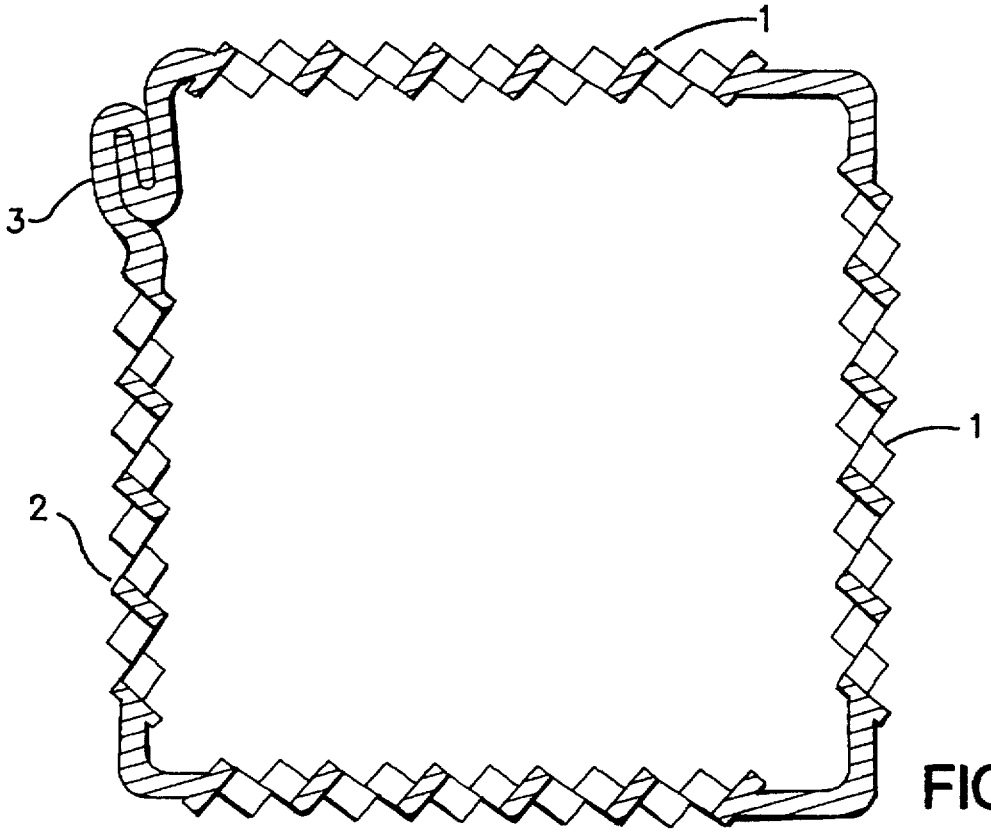
FIG. 3 is a cross-sectional view of the present invention.
Figure 4:
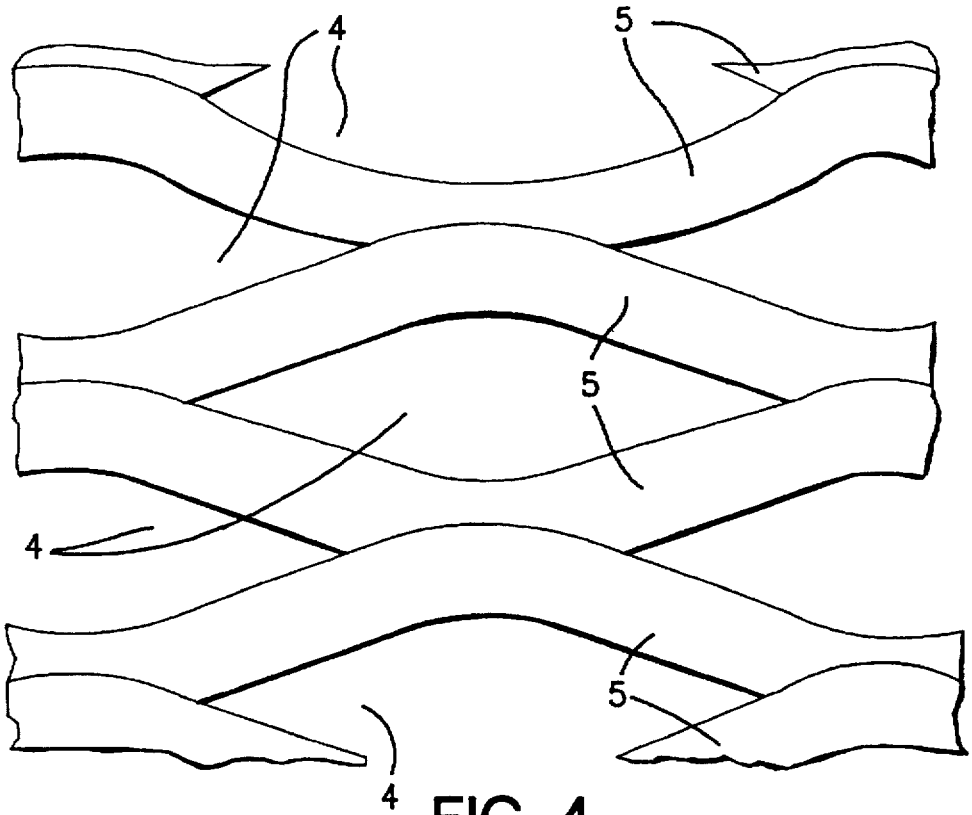
FIG. 4 is a detailed view of the present invention.
Figure 5:
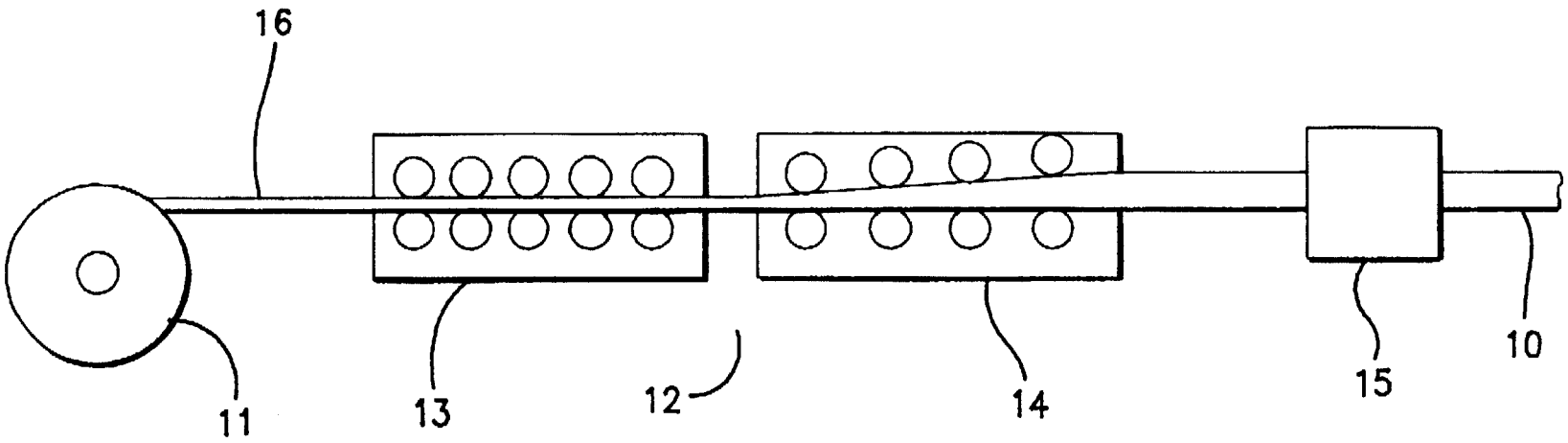
FIG. 5 is a schematic view of the manufacturing process to make the beam of the present invention.

The present invention is described below in greater detail with reference to the accompanying drawings. FIG. 1 shows a view from the side of an embodiment of a beam in accordance with the present invention. FIG. 2 shows a view from another side of the beam in FIG. 1. FIG. 3 shows a cross-section through the beam in FIGS. 1 and 2 to illustrate its quadrangular profile. FIG. 4 shows on a large scale a part of a section of strip metal in the beam in accordance with the previous Figures. FIG. 5 shows a line for the manufacture of beams in accordance with the invention.

The embodiment of a beam in accordance with the present invention shown in the drawings may, in principle, be of infinite length and of any desired profile, although it is shown in FIG. 3 to have a quadrilateral and essentially square profile. A beam in accordance with the present invention may, as stated, exhibit any suitable profile, for example a two-sided oval profile or elliptical profile, a quadrilateral profile or a quadrangular profile in accordance with the drawings, a three-sided profile and many variants and combinations of such profiles. It is conceivable, for example, to have a profile which consists in principle of a number of triangular profiles, for example three triangular profiles or even four triangular profiles, which are attached or connected to one another in an appropriate fashion, for example with their tips meeting one another. Quadrangular profiles need not be square, of course, but may exhibit in principle any quadrangular form. The angles in the quadrilateral profiles also need not be 90°, but may be angles other than right-angles.

The beam illustrated in the drawings is quadrilateral, as already mentioned above, and has a section 1 of expanded metal on each of the three sides and a section 2 of expanded metal on the fourth side. The fourth side also exhibits a folded section 3 of essentially conventional type. The profile exhibits unbroken sections between the sides. The folded section 3 engages in an essentially conventional fashion in the two meeting, unbroken edge sections that are obtained after profiling of the beam to the quadrangular form shown.

The folded section 3 may be replaced by some other form of connection or folding. The connection may well consist of a weld in the form of a spot weld or a seam weld. The choice of connection or attachment depends largely on the choice of material used for the metal strip.

FIG. 4 illustrates a part of the sections 1, 2 of expanded metal in detail, and it can be appreciated from this detailed Figure that the sections of expanded metal have a conventional form with a number of holes between bridges or connections 5 in the sheet metal itself.

It is also possible, of course, to have other types of expanded metal structures, although the type illustrated is the preferred type. It must be pointed out in this respect that the upward-facing curves in the bridges 5 are displaced up and out of the plane of the drawing, whereas the downward-facing curves of the bridges 5 are displaced inwards and into the plane of the drawing, although they are connected to one another in such a way that the upward-facing curve is connected to the downward-facing curve.

It must also be pointed out that it is naturally not necessary for the beam to exhibit sections of expanded metal on all sides, but that it may be appropriate in certain cases to have expanded metal on one or two sides, for example two opposing sides, or on two or three adjacent sides of a quadrangular beam. It is also conceivable to have an oval beam, in which one side exhibits a section of expanded metal, whereas the other side is unbroken. The unbroken edge sections may be provided with sections of expanded metal or holes intended to lighten the structure.

The sheet metal from which a beam in accordance with the present invention is manufactured may consist of many different materials, for example aluminium, or steel etc.

A beam in accordance with the present invention can be manufactured in an expander, which makes it possible to achieve sections of expanded metal that are separated by unbroken sections of sheet metal, in conjunction with which a profiling machine and a folding machine or a welding machine are positioned directly after the expander in question. The profiling machine and the folding machine or the welding machine may be separate machines from the expander.

A beam in accordance with the present invention will exhibit sufficiently good strength characteristics, and may be manufactured at such low cost that it will be capable of being used within the construction industry as a load-bearing structural beam, where it can replace the wooden beams of both small and large dimensions used today.

BUSINESS IDEA

Self-contained profiles of expanded metal and unperforated plate are manufactured from a coil of sheet metal strip. Expanded metal profiles with edges and/or strips of unperforated plate are roller-formed. The invention allows manufacturing of a large quantity of products.

APPLICATIONS pillars and beams for building constructions containers and buildings in steel and aluminium, for example building platform accommodation energy-absorbing supporting structures for road equipment, for example light columns furniture frames tubular structures cable support system and protection (shielding), refining elements and diffusers, etc.

insulation of tunnels for noise absorption impact safety in the design of motor vehicles rib frames, for example in lightweight boats

PROPERTIES low weight low energy transmission (noise and heat)

high energy absorption by deformation low-cost, rapid production in large quantities simple perforation and jointing, etc.

flexibility of design and product qualities

GENERAL

Machine investment cost depends on the thickness of the metal strip, the width of the metal strip and the post-production equipment A rotary expander has high production capacity Each unit can be produced at a lower cost compared to a profile made from untreated metal strip of the same plate thickness Processing and material savings give the product a surplus The invention offers wide scope for giving each product the specific qualities demanded, and The technique is today best suitable for metal strip of up to 3–5 mm in thickness.

MANUFACTURING PROCESS

The aforementioned profiles can be manufactured in a straight line from a coil of sheet metal strip. A production line can consist of a rotary expander, a roller-former and, for example, a high-frequency (HF) welding machine or an edge folder followed by a cross-cutting machine. Sections of the metal strip are expanded in the rotary expander. Areas of unperforated metal are left between the expanded areas. A self-contained profile, for example round or square, is shaped in the roller-former. The unperforated area forms the edges in cornered profiles. The profiles are sealed, for example, with a weld or a folded seam. If a folded seam is chosen, the seam is produced in the roller-forming process. A welded seal is made as in the case of tube manufacturing, using an HF weld. Other methods of profile sealing can be used.

Many modifications are conceivable, of course, within the scope of the idea of invention defined in the following Patent Claims.

I claim:

1. A beam having a closed profile, comprising:

an elongate member having a first intermediate side section and a second intermediate side section that is integrally attached to the first intermediate side section by a first solid portion, the elongate member having a third intermediate side section that is integrally attached to the second intermediate side section by a second solid portion, the first, second and third intermediate side sections being made of a sheet metal strip including an expanded metal; and the elongate member having a first side edge and a second side edge, the first side edge having an interlocking mechanism and the second side edge having an interlocking mechanism so that the first side edge is interlocked with the second side edge by the interlocking mechanisms to form a closed profile.

2. The beam according to claim 1 wherein the side edges of the elongate member are made of a solid material.

3. The beam according to claim 1 wherein the side edges of the elongate member are made of a solid material and the side edges are attached to one another by welding the side edges to each other.

4. The beam according to claim 1 wherein the beam is a quadrilateral closed profile and the side edges of the elongate member are attached to one another at a corner of the quadrilateral closed profile.

5. A method of manufacturing profiles of expanded metal comprising the steps of:

providing a straight production line;

providing a coiled sheet metal strip having a first side edge and a second opposite side edge, the coiled sheet metal strip having a first, second and third side section, the first side section being integrally attached to the second side section and the third side section being integrally attached to the second side section;

providing a rotary expander, roll former, and a welding machine disposed on the production line;

expanding the first, second and third side section of the sheet metal strip in the rotary expander;

forming the expanded sheet metal strip into a closed profile in the roll former; and welding the first side edge of the sheet metal strip to the second opposite side edge in the welding machine when the sheet metal strip is in the closed profile.

6. The method according to claim 5 wherein the step of expanding the sheet metal strip comprises the steps of expanding portions of the sheet metal strip and separating the expanded portions with solid elongate portions and the step of forming the expanded sheet metal comprises bending the solid elongate portions of the sheet metal strip and forming a self-contained profile and sealing the self-contained profile.

7. The method according to claim 6 wherein the step of forming the self-contained profile comprises forming a square shaped profile.

8. The method according to claim 6 wherein the step of sealing the self-contained profile comprises welding together edges of the self-contained profile.

9. The method according to claim 6 wherein the step of sealing the self-contained profile comprises folding a first edge of the self-contained profile about a second edge of the self-contained profile.

10. The method according to claim 5 wherein the step of expanding the sheet metal strip comprises producing a folded seam in the sheet metal strip.

11. The method according to claim 5 wherein the step of welding comprises the step of providing a high frequency welding machine and producing a welded seam in the sheet metal strip.

* * * * *